US008490426B2

(12) United States Patent
Kim

(10) Patent No.: US 8,490,426 B2
(45) Date of Patent: Jul. 23, 2013

(54) DOOR BASKET FOR REFRIGERATOR

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 895 days.

(21) Appl. No.: 12/634,494

(22) Filed: Dec. 9, 2009

(65) Prior Publication Data

US 2010/0175404 A1 Jul. 15, 2010

Related U.S. Application Data

(60) Provisional application No. 61/145,007, filed on Jan. 15, 2009.

(51) Int. Cl.
*F25D 23/00* (2006.01)

(52) U.S. Cl.
USPC ..... 62/264; 62/449

(58) Field of Classification Search
USPC ..... 62/264, 449, 382, 78; 362/92, 545, 362/612; 312/402, 408; 426/248
See application file for complete search history.

(56) References Cited

U.S. PATENT DOCUMENTS

| | | | | | |
|---|---|---|---|---|---|
| 2,455,182 | A * | 11/1948 | La Vallee | 62/131 |
| 4,751,826 | A * | 6/1988 | Kawahara et al. | 62/382 |
| 5,157,940 | A * | 10/1992 | Bertu et al. | 62/382 |
| 5,253,488 | A * | 10/1993 | Kim et al. | 62/382 |
| 5,303,997 | A * | 4/1994 | Kropf | 312/334.4 |
| 5,901,564 | A * | 5/1999 | Comeau, II | 62/264 |
| 7,147,341 | B2 * | 12/2006 | Nowak et al. | 362/133 |
| 7,669,944 | B2 * | 3/2010 | Oh et al. | 312/404 |
| 7,686,406 | B2 * | 3/2010 | Lee | 312/405.1 |
| 7,810,891 | B2 * | 10/2010 | Lee et al. | 312/402 |
| 2007/0104841 | A1 * | 5/2007 | Min et al. | 426/248 |
| 2008/0307818 | A1 * | 12/2008 | Min et al. | 62/264 |

* cited by examiner

*Primary Examiner* — Mohammad M Ali
(74) *Attorney, Agent, or Firm* — Birch, Stewart, Kolasch & Birch, LLP

(57) ABSTRACT

Provided is a door basket of a refrigerator including a lighting device capable of emitting light. According to above-described configuration, illumination can be improved at the door basket, and an outer appearance thereof can be elegant.

14 Claims, 8 Drawing Sheets

DOOR BASKET FOR REFRIGERATOR

This Non-Provisional application claims priority under 35 U.S.C. 119(e) on U.S. Provisional Application No. 61/145,007, filed on Jan. 15, 2009, the entire contents of which are hereby incorporated by reference.

BACKGROUND

Embodiments relate to a door basket for a refrigerator.

Generally, a refrigerator includes a plurality of storage compartments for receiving foods to store the foods in freezing or refrigeration state. One surface of each of the storage compartments is opened to receive and dispense the foods.

A door selectively covering the storage compartment is provided in a front direction of the storage compartment. A door basket for receiving the foods may be disposed on a back surface of the door.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
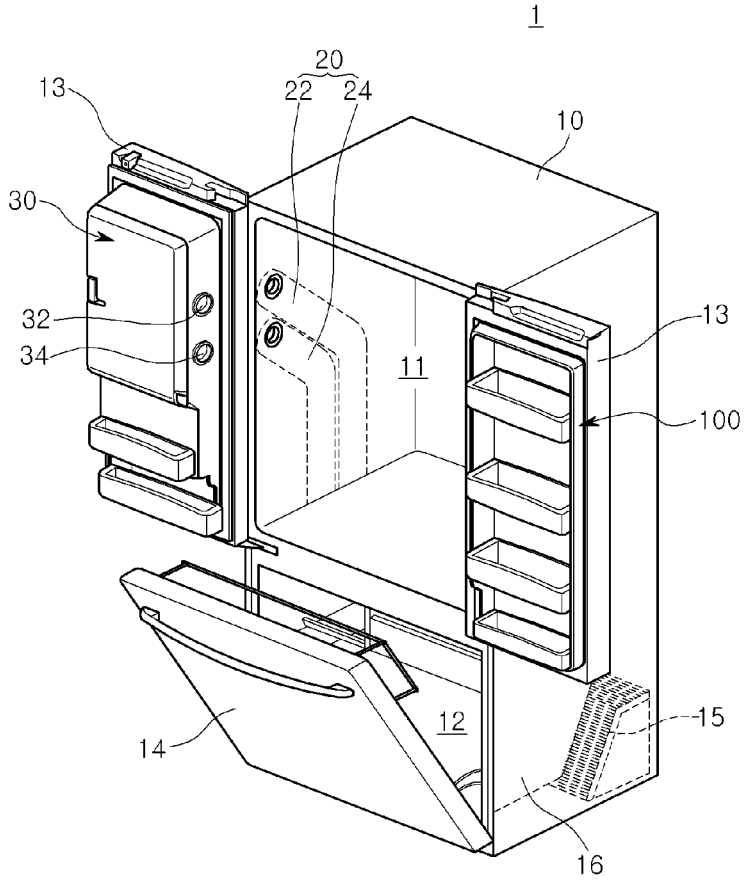
FIG. 1 is a perspective view of a refrigerator according to an embodiment.

FIG. 1 is a perspective view of a refrigerator according to an embodiment.

Referring to FIG. 1, a refrigerator 1 according to this embodiment includes a main body 10 defining a refrigerator compartment 11 and a freezer compartment 12 and having an opened front surface and doors 13 and 14 provided on the front surface of the main body 10 and rotatably coupled to the main body 10.

The doors 13 and 14 include a refrigerator compartment door 13 for selectively covering the refrigerator compartment 11 and a freezer compartment door 14 for selectively covering the freezer compartment 12. Here, the refrigerator compartment door 13 is provided on an upper portion of the main body 10, and the freezer compartment door 14 is provided on a lower portion of the main body 10.

A bottom freezer type refrigerator in which a freezer compartment is disposed under a refrigerator compartment is described in this embodiment as an example. However, the present disclosure is not limited to this embodiment. For example, a refrigerator according to this embodiment may be applied to following various refrigerators: a top mount type refrigerator in which a refrigerator compartment is disposed under a freezer compartment; and a side by side type refrigerator in which a refrigerator compartment and a freezer compartment are disposed in left and right sides, respectively.

In detail, the refrigerator compartment door 13 is provided in plurality at both upper sides of the main body 10 and rotatably coupled with respect to both ends of the main body 10. Here, a hinge shaft (not shown) that defines a rotation center may be inserted in a side of the refrigerator compartment door 13.

The freezer compartment door 14 is coupled to a lower portion of the main body 10. The freezer compartment door 14 may have a drawer-type shape and be withdrawable to the outside.

An evaporator 15 in which cool air supplied inside the main body 10 is generated is provided at a rear side of the lower portion of the main body 10. A storage box 16 in which foods are stored and from which the foods are withdrawable is provided inside the freezer compartment 12.

An ice-making device 30 that makes ice using supplied water is provided on a back surface of the refrigerator compartment door 13. The ice-making device 30 includes a cool air supply part 32 and a cool air exhaust part 34 through which the cool air is supplied or exhausted into/from the freezer compartment 12.

A cool air duct 20 through which the cool air flows is provided inside a surface of main body 10. The cool air duct 20 includes a supply duct 22 through which the cool air is supplied into the cool air supply part 32 and an exhaust duct 24 through which the cool air exhausted from the cool air exhaust part 34 flows.

One side of the supply duct 22 and one side of the exhaust duct 24 are connected to one side of the freezer compartment 12. At least portion of the cool air generated by the evaporator 15 is supplied into the ice-making device 30 through the supply duct 22. The cool air circulating in the ice-making device 30 is exhausted through the exhaust duct 24, and then may be introduced into the freezer compartment 12.

A plurality of door baskets 100 for receiving the foods may be provided on the back surface of the refrigerator compartment door 13. The plurality of door baskets 100 may be disposed spaced from each other along a length direction of the door 13. Hereinafter, a configuration of each of the door baskets 100 will be described with reference to accompanying drawings.

Figure 2:
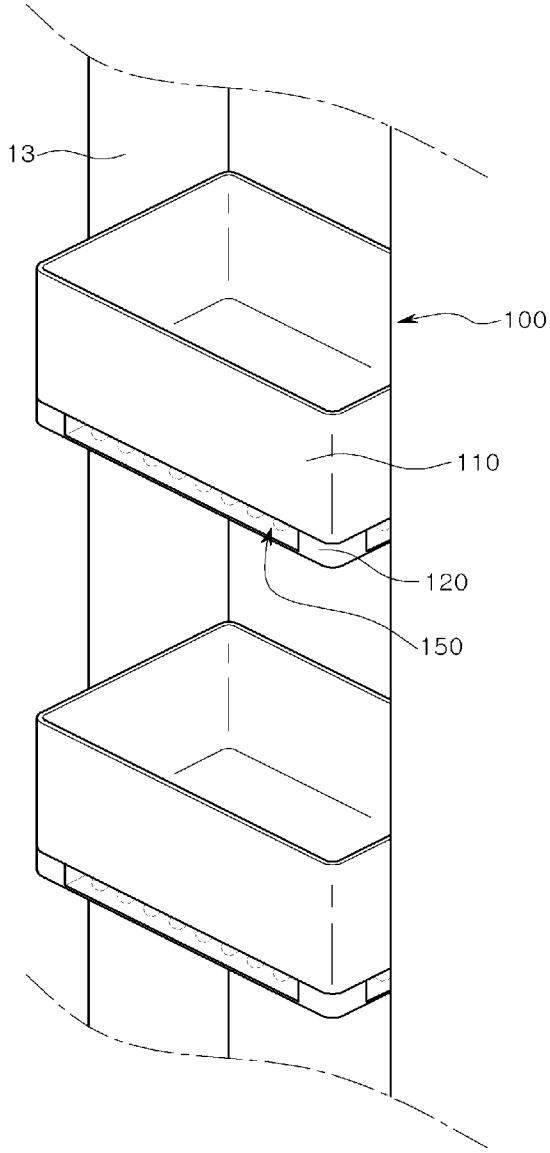
FIG. 2 is a perspective view illustrating a door basket of a refrigerator according to an embodiment.
Figure 3:
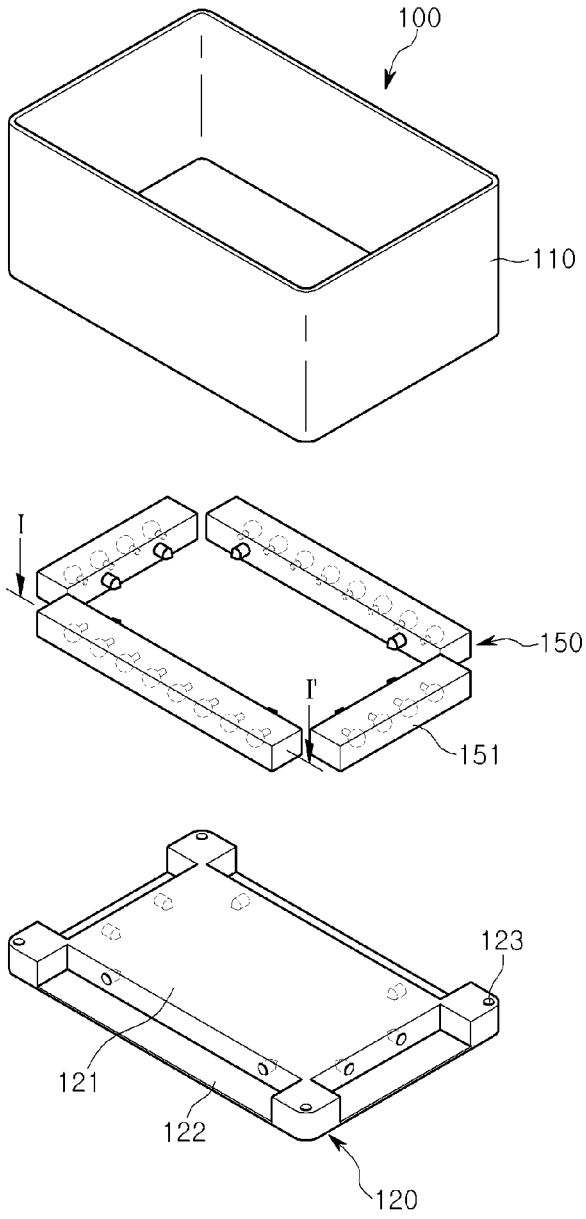
FIG. 3 is an exploded perspective view of a door basket according to an embodiment.
Figure 4:
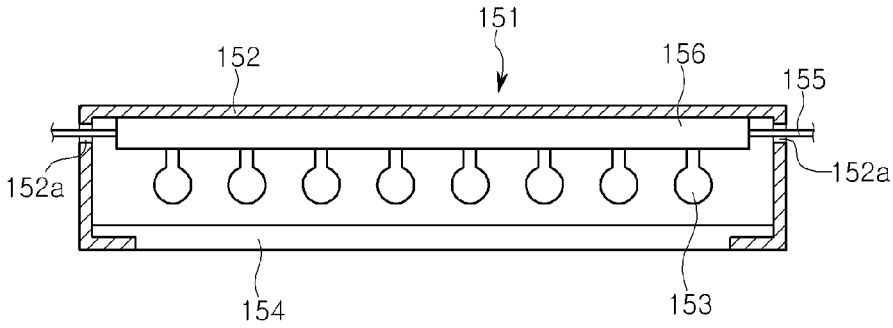
FIG. 4 is a cross-sectional view taken along line I-I' of FIG. 3.

FIG. 2 is a perspective view illustrating a door basket of a refrigerator according to an embodiment, and FIG. 3 is an exploded perspective view of a door basket according to an embodiment. FIG. 4 is a cross-sectional view taken along line I-I' of FIG. 3.

Referring to FIGS. 2 to 4, the door basket 100 according to this embodiment includes a basket body 110 defining a storage space and a lower cover 120 disposed on a lower portion of the basket body 110. The door basket 100 may slightly protrude from the back surface of the refrigerator compartment door 13 toward the inside of the main body 10.

In detail, a lighting device 150 for emitting light is provided in the door basket 100. The lighting device 150 may be disposed along a circumference of the lower cover 120.

The lighting device 150 includes a plurality of light emitting device (LED) modules 151 respectively disposed at four edges of the lower cover 120.

Each of the LED modules 151 includes a housing 152, LEDs 153, and a board 156. The housing 152 defines the LED module 151 and has an opened surface. The LEDs 153 are provided inside the housing 152 to emit the light. The board 156 is provided on a side of the LEDs, and electric circuits and components for emitting the light are mounted on the board 156.

A transparent window 154 covering the opened surface of the housing 152 is provided in the LED module 151. The transparent window 154 may be formed of a transparent or semitransparent material to transmit the light emitted from the LEDs 153 to the outside.

An electric wire 155 through which a power is supplied is provided in the board 156. The electric wire 155 extends in both side directions of the board 156. Through holes 152*a* through which the electric wire 155 passes are defined in the housing 152.

The electric wire 155 may pass through the housing 152 and be connected to different adjacent LED modules 151. An electric wire of one LED module of the plurality of LED modules 151 may be connected to a power supply part (See reference numeral 90 of FIG. 7) of the refrigerator. Although not shown, the electric wire 155 may extend to the power supply part 90 through a space in which the hinge shaft of the refrigerator compartment door 13 is inserted.

The lower cover 120 includes a cover body 121 and a module seat 122. The cover body 121 covers a lower portion of the basket body 110. Each of the LED modules 151 disposed along the circumference of the cover body 121 is seated on the module seat 122.

A portion of a top surface of the cover body 121 is depressed downwardly to form the module seat 122. The module seat 122 has a size corresponding to that of each of the LED modules 151.

A coupling part 123 for coupling the lower cover 120 to the basket body 110 is defined in the lower cover 120 to pass through the lower cover 120. A coupling member (not shown) may be coupled to the coupling part 123.

Figure 5:
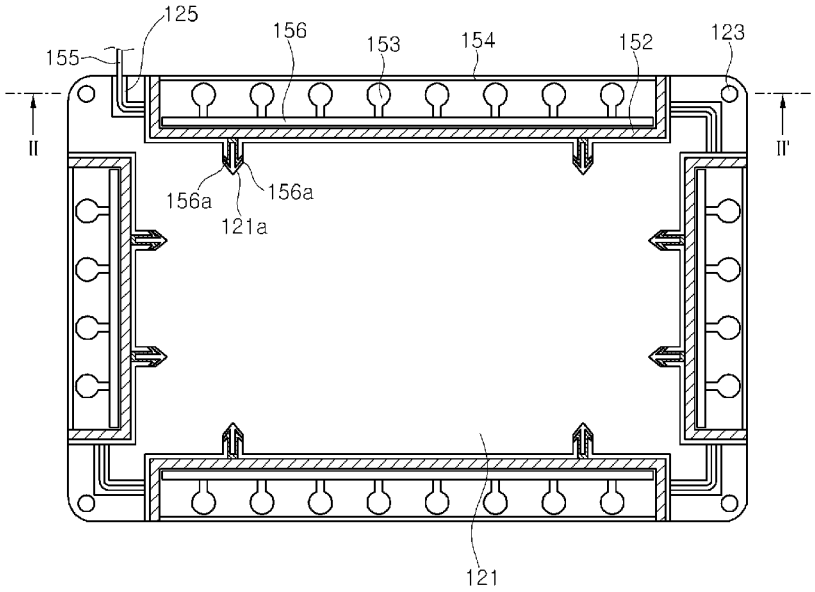
FIG. 5 is a cross-sectional view of a light emitting device coupled to a lower cover according to an embodiment.
Figure 6:
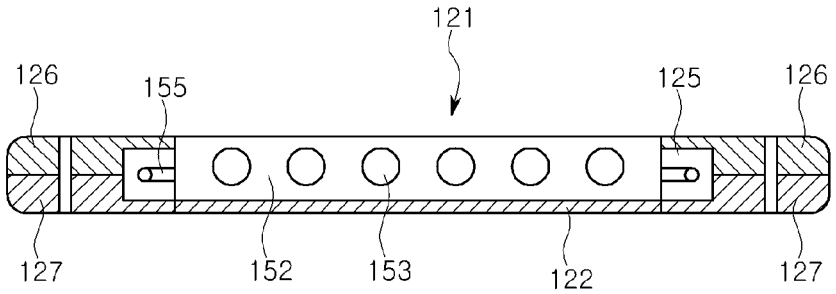
FIG. 6 is a cross-sectional view taken along line II-II' of FIG. 5.

FIG. 5 is a cross-sectional view of a light emitting device coupled to a lower cover according to an embodiment, and FIG. 6 is a cross-sectional view taken along line II-II' of FIG. 5.

Referring to FIGS. 5 and 6, the plurality of LED modules 151 may be detachably coupled to the cover body 121. A fitting protrusion 156 fitted in the cover body 121 is disposed on the LED module 151. The fitting protrusion 156 protrudes in a rear side direction of the housing 152. A fitting groove 121*a* in which the fitting protrusion 156 is fitted is disposed in the cover body 121. The fitting protrusion 156 and the fitting groove 121*a* may be provided in plurality, respectively.

A plurality of hooks 156*a* hooked to both side ends of the fitting groove 121*a* is provided on the fitting protrusion 156. The plurality of hooks 156*a* extends from an outer surface of the housing 152 and is spaced from each other.

The plurality of hooks 156*a* may be elastically deformed in a direction in which they get close to each other in a process in which the fitting protrusion 156 is fitted in the fitting groove 121*a*. When the fitting protrusion 156 is completely fitted in the fitting groove 121*a*, each of the hooks 156*a* may be restored, and thus closely attached to the fitting groove 121*a*.

The cover body 121 includes an upper cover 126 defining an outer appearance of an upper portion thereof and a lower cover 127 defining an outer appearance of a lower portion. The coupling part 123 passes through the cover body 121 in a state where the upper cover 126 is coupled to the lower cover 127.

An electric wire guide 125 for guiding the electric wire 155 is provided in the cover body 121. The electric wire guide 125 may have a groove shape at both sides of each of the LED modules 151.

Figure 7:
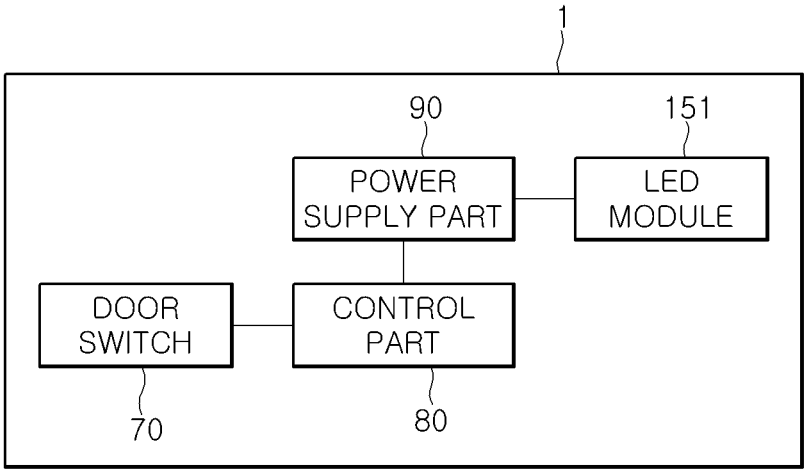
FIG. 7 is a block diagram illustrating a configuration of a refrigerator according to an embodiment.

FIG. 7 is a block diagram illustrating a configuration of a refrigerator according to an embodiment.

Referring to FIG. 7, a refrigerator 1 according to this embodiment includes a power supply part 90, an LED module 151, a door switch 70, and a control part 80. The power supply part 90 supplies a power source to the refrigerator 1. The LED module 151 receives the power source from the power supply part 90. The door switch 70 is provided in a main body 10 and selectively contacts with a door 13 to detect opening or closing of the door 13. The control part 80 controls ON/OFF of the power source supplied from the power supply part 90 to the LED module 151 according to a signal transmitted from the door switch 70.

An operation according to the configuration will be simply described.

When the door 13 is closed, the door switch 70 maintains an OFF state, and the OFF state is transmitted to the control part 80. Then, the control part 80 cuts off the supply of the power source transmitted from the power supply part 90 to the LED module 151.

On the other hand, when the door 13 is opened, the door switch 70 maintains an ON state. Then, the control part 80 receives an ON signal from the door switch 70 to supply the power source from the power supply part 90 to the LED module 151.

Since the LED module 151 operates only in open state of the door 13, power consumption can be reduced.

Since light is emitted from the LED module 151 in a state where the door 13 is opened, illumination can be improved at the door 13, and an outer appearance of the door 13 can be elegant.

Hereinafter, another embodiment of the present disclosure will be described. When comparing this embodiment with the previously described embodiment, this embodiment is identical to the previously described embodiment except for a configuration of a lower cover 220. Therefore, the same reference numbers will be used throughout the drawing to refer to the same or like parts as those in the previously described embodiment.

Figure 8:
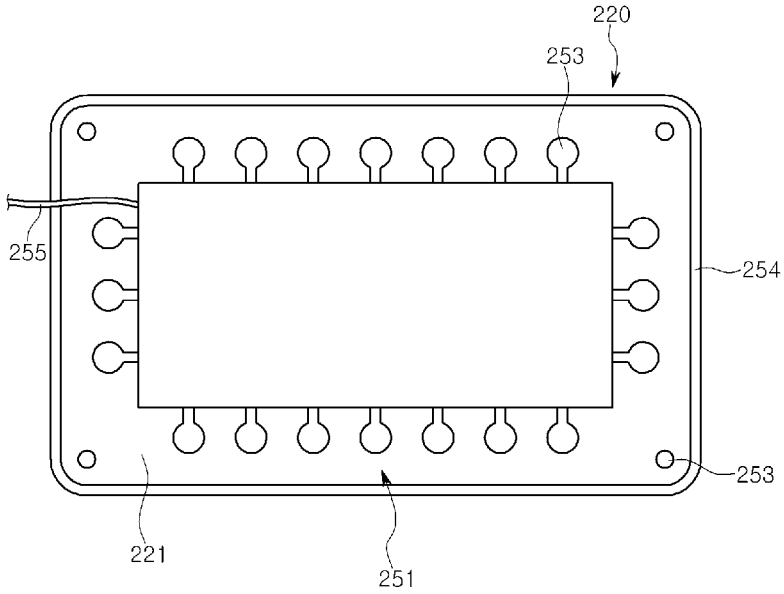
FIG. 8 is a view illustrating a configuration of a lower cover according to another embodiment.

FIG. 8 is a view illustrating a configuration of a lower cover according to another embodiment.

Referring to FIG. 8, a lower cover 220 according to this embodiment includes a cover body 221 defining an outer appearance and an LED module 251 provided on an upper side of the lower cover 220 to emit light to the outside. Although not shown, the cover body 221 and the LED module 251 may be coupled to each other using a predetermined coupling member.

The lower cover 220 may be coupled to a basket body 110 in a state where the LED module 251 is installed on the lower cover 220. For this, a coupling part 253 is provided in the cover body 221.

The LED module 251 includes a board 252, a plurality of LEDs 253, and an electric wire 255. Electric circuits and components are mounted on the board 252. The plurality of LEDs 253 is disposed along an outer circumference of the board 252. The electric wire 255 is provided at a side of the board 252 to supply a power source from a power supply part 90.

A transparent window 254 through which light emitted from the LEDs 253 is easily illuminated to the outside is provided on an outer surface of the cover body 221. The transparent window 254 may be formed of a transparent or semitransparent material. The light emitted from the LEDs 253 may be displayed in various ambiences.

As described above, since the plurality of LEDs 253 is mounted on one board 252, and then the board 252 is coupled to the basket body 110, the LEDs 253 can be easily installed.

Further another embodiment will be proposed.

Although the light is emitted outside the basket in the previously described embodiments, the light may be emitted upwardly in this embodiment.

That is, the LEDs and the board may be respectively disposed at upper and lower portions with respect to each other to emit the light emitted from the LEDs in an upward direction. In this case, the door and the door basket can be displayed in elegant ambience.

What is claimed is:

1. A refrigerator, comprising:

a body having a door;

a basket mounted to the door, the basket having a base and at least one side wall extending upwardly from the base; and a light source disposed in the basket, the light source emitting light in a direction away from the base.

2. The refrigerator of claim 1, wherein the light source is an LED.

3. The refrigerator of claim 1, wherein the light source is in the base.

4. The refrigerator of claim 1, wherein the base comprises a central section, a recess formed at an edge of the base, and a light module retained in the recess.

5. The refrigerator of claim 4, wherein the light module is an LED module.

6. The refrigerator of claim 4, further comprising a recess along each edge of the base and a light module retained in each recess.

7. The refrigerator of claim 1, further comprising a switch in the refrigerator, the switch activated by the opening and closing of the at least one door, the switch controlling power to the light source.

8. The refrigerator of claim 1, wherein the base comprises a central section and a recess formed at an edge of the base, the light source comprises a light module having a board, the board having a fastener, the fastener of the board engaging a mating fastener in the base central section, and the at least one side wall is connected to the base by a side wall fastener.

9. The refrigerator of claim 1, wherein the cooling compartment is a refrigeration compartment.

10. The refrigerator of claim 1, wherein the base comprises a central projection, the edges of the central projection being spaced from the edges of the base, and wherein the light source extends from the central projection.

11. The refrigerator of claim 1, wherein the light source comprises a plurality of light emitting devices.

12. The refrigerator of claim 11, wherein the light emitting devices are aligned in a horizontal row.

13. The refrigerator of claim 1, further comprising a light source on each side of the basket.

14. The refrigerator of claim 4, wherein the light module has a transparent window.

* * * * *